United States Patent [19]

Klenik, Jr. et al.

[11] 3,957,324

[45] May 18, 1976

[54] DRAWER CABINET ANTI-TIP DEVICE

[75] Inventors: Ralph L. Klenik, Jr.; Ralph E. Dyar, both of Marietta, Ohio

[73] Assignee: Sperry Rand Corporation, New York, N.Y.

[22] Filed: Mar. 26, 1974

[21] Appl. No.: 454,868

[52] U.S. Cl. ..... 312/218; 312/221; 312/217

[51] Int. Cl.[2] ..... E05B 65/46; E05C 7/06

[58] Field of Search ..... 312/215–222

[56] References Cited

UNITED STATES PATENTS

| | | | |
|---|---|---|---|
| 1,193,955 | 8/1916 | Watson et al. | 312/217 |
| 2,240,067 | 4/1941 | Bolesky et al. | 312/218 |
| 2,810,616 | 10/1957 | McClellan | 312/218 |
| 2,842,419 | 7/1958 | Howard | 312/218 |
| 2,886,392 | 5/1959 | Stegmaier | 312/217 |
| 3,323,849 | 6/1967 | Stark | 312/221 |

*Primary Examiner*—Paul R. Gilliam
*Assistant Examiner*—Victor N. Sakran
*Attorney, Agent, or Firm*—Griffin, Branigan and Butler

[57] ABSTRACT

A file-cabinet anti-tip device allows only one drawer to be withdrawn from a cabinet at a time. The device maintains cabinet-mounted drawer latches in drawer-unlocked positions when all of the drawers in the cabinet are closed, but moves the latches of the remaining drawers to drawer-locked positions in response to any one of the drawers being withdrawn from the cabinet. An actuating means includes a cabinet-mounted movable lock rod which is linked to the drawer latches, drawer-mounted cams and cabinet-mounted movable levers to move the lock rod in response to movement of the cams. The device of this invention can be easily integrated with conventional push-button-type file-cabinet locking mechanisms as well as combination-type locking mechanisms.

5 Claims, 4 Drawing Figures

DRAWER CABINET ANTI-TIP DEVICE

BACKGROUND OF THE INVENTION

This invention relates broadly to the art of drawer cabinets and more particularly to the art of drawer cabinets having drawer interlocking mechanisms.

A difficulty with many drawer cabinets, such as filing cabinets, is that when more than one of their drawers is withdrawn at a time, they cannot support the combined weights of these drawers and they tend to fall over forwards. This problem is especially present with insulated, lateral filing cabinets which have unusually heavy drawers due to insulation and which normally provide less support than other filing cabinets because they lack depth.

This problem can be solved by attaching filing cabinets to floors or walls by means of fastening devices such as nails, screws, bolts or the like. However, such a solution makes filing cabinets difficult to install or move to new positions, and tends to damage the floors and walls.

Another solution is to add weight to the backings of filing cabinets to offset drawer weight; however, such a solution makes filing cabinets heavier and, therefore, more expensive to ship and handle. It is therefore an object of this invention to provide a drawer cabinet anti-tip safety device which does not make cabinets unduly difficult or costly to install or to move.

It has been suggested to limit the withdrawal of drawers from a cabinet by attaching a single tether to back ends of the drawers. The tether has sufficient slack to allow only one drawer to be completely withdrawn from the cabinet at a time. This system has the disadvantage, however, of not being sufficiently positive in action to prevent partial withdrawal of more than one drawer at a time. Further, such a tether tends to impede drawer motion and the slack thereof is cumbersome to store. Thus, it is an object of this invention to provide a drawer cabinet anti-tip safety device which allows appreciable withdrawal of only one drawer at a time, which does not impede drawer motion and which is compact in size.

A drawer cabinet anti-tip device should be relatively uncomplicated in structure and inexpensive to manufacture and install. It is an object of this invention to provide such a drawer cabinet anti-tip device.

SUMMARY OF THE INVENTION

According to principles of this invention, a drawer cabinet anti-tip device includes a linkage for moving cabinet mounted latches to drawer-mounted catch disengaging positions in response to all of the drawers of a drawer column being in closed positions, but for causing the latches to move to catch-engaging positions in response to one of the drawers being withdrawn from the cabinet. The linkage comprises a cabinet-mounted movable rod which is linked to the cabinet-mounted latches and which is moved via drawer-mounted cams and cabinet-mounted levers in response to drawer withdrawal and insertion. The rod is caused to move to a drawer unlocking position in response to all drawers being placed in closed positions but is positively moved to a drawer locking position in response to one of the drawers being withdrawn from the cabinet. The drawer cabinet anti-tip device of this invention can be easily integrated with existing filing-cabinet locking systems.

BRIEF DESCRIPTION OF THE DRAWINGS

The foregoing and other objects, features and advantages of the invention will be apparent from the following more particular description of preferred embodiments of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
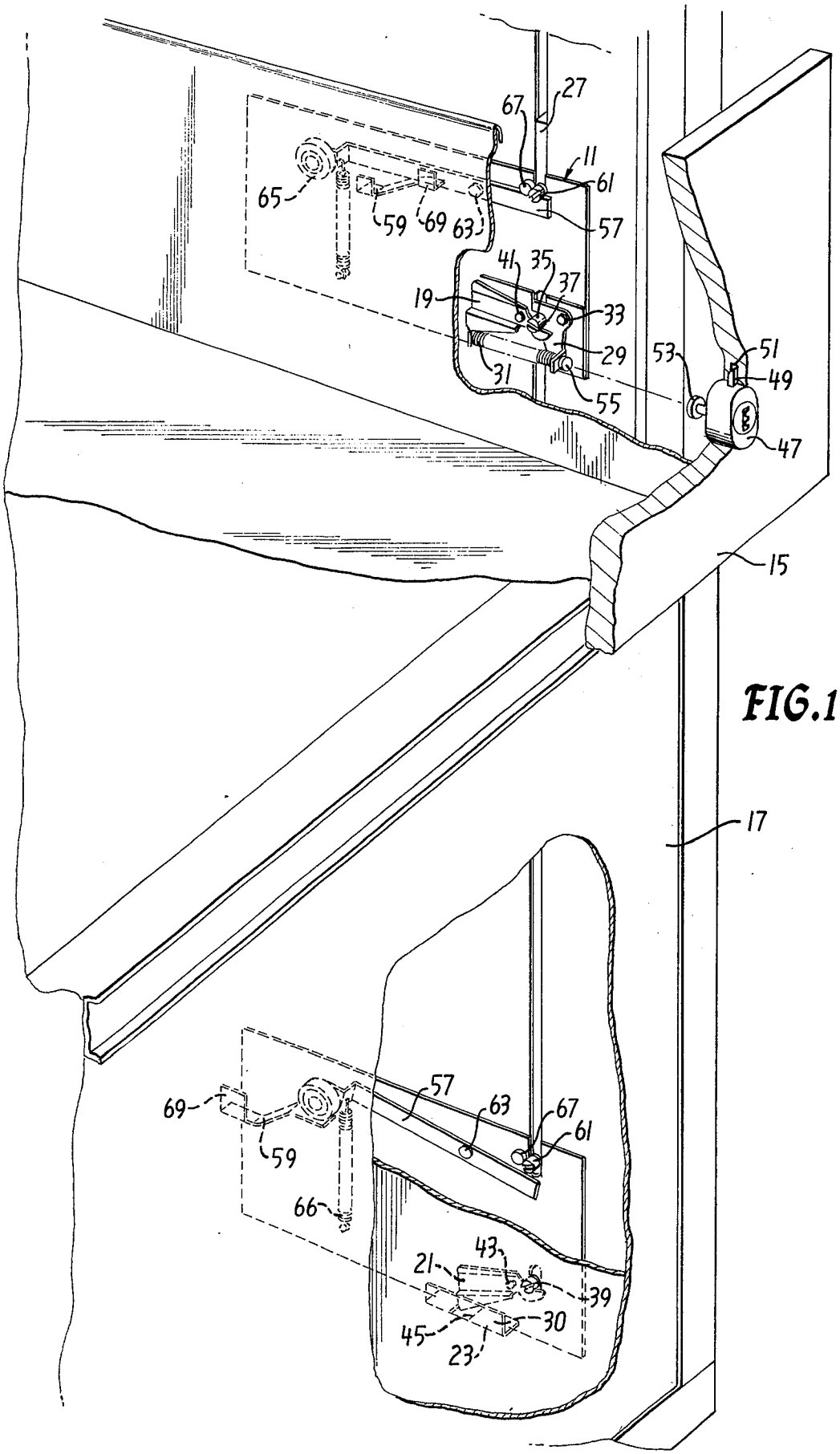
FIG. 1 is an isometric, cut-away view of a portion of a filing cabinet which employs an anti-tip device of this invention.

With reference to FIG. 1, a filing-cabinet anti-tip safety device 11 is mounted on a filing cabinet 13 for interlocking cabinet drawers 15 and 17 so that only one of these drawers can be withdrawn from the cabinet 13 at a time. In this regard, for simplicity, the invention is described herein as being used with a two-drawer cabinet; however, it should be understood that it could be used with a column of drawers having any desired number of drawers.

The anti-tip safety system 11 is integrated with, and partially includes, a normal drawer locking system which primarily consists of cabinet-mounted drawer latches 19 and 21, drawer-mounted catches (only one shown in FIG. 1) 23, a lock rod 17 and a cabinet-mounted lock lever 29. In the FIGS. 1–3 embodiment the catches 23 (only one shown in FIG. 1) are mounted on drawers by their flanges 30 and are identically located along their respective drawers 15 and 17. When the drawers of the filing cabinet 13 are in a closed, but unlocked, configuration, a compression spring 31 tends to rotate the lock lever 29 about a lock-lever pivot pin 33 in a counterclockwise direction to move a latch pin 35, held in a slot 37 of the lock lever 29, in a downward direction. The latch pin 35 is fixidly attached to the lock rod 27 and, therefore, the entire rod is moved downwardly so that the other attached latch pin 39 is also moved downwardly. The latch pins 35 and 39 press on ends of the latches 19 and 21 to cause them to rotate in a clockwise direction about latch pivot pins 41 and 43. Thus, the latches 19 and 21 are rotated out of slots 45 (only one shown) in drawer-mounted catches 23 (only one shown) to allow either of the drawers 15 or 17 to be withdrawn from the filing cabinet 13. Coiled springs 46 (FIGS. 2 and 3) positively bias the latches 19 and 21 in counterclockwise directions toward drawer-locking, catch-engaging positions.

When it is desired to lock the drawers 15 and 17 in closed positions, a locking button 47 is pressed inwardly until a lock latch 49 engages a slot 51 to hold the locking button 47 in. In this position, a plunger 53 presses on a rod 55 to compress the compression spring 31 and rotate the lock lever 29 to lift the lock rod 27.

In this mode, the latches 19 and 21 engage slots 45 in drawer-mounted catches 23 (one shown) to prevent drawer withdrawal from the filing cabinet 13. When it is desired to unlock the drawers, a key is used to withdraw the lock latch 49 from the slot 51 and thereby allow the locking button 47 to be pushed outwardly by a biasing member (not shown) so that the plunger 53 withdraws from the rod 55. Now the lock rod 27 is once again in a down, drawer-unlocking, position to disengage the latches 19 and 21 from the catches 23. The structure described thus far is relatively conventional.

The elements which are added to this system to make it an anti-tip system basically include cabinet-mounted levers 57, drawer-mounted cams 59 and lock-rod pins 61.

The levers 57 are rotatably mounted to an inside wall of the filing cabinet 13 by lever pivot pins 63. The levers 57 include lever rollers 65 at first ends thereof. The levers 57 are biased toward counterclockwise positions, as seen in FIG. 1, by tension springs 66. When any one of the levers 57 is in an extreme counterclockwise position, as depicted in FIG. 3 and in the upper drawer of FIG. 1, a respective lock-rod pin 61, and the attached lock rod 27, is raised to a position which is determined by the respective stop 67.

The cams 59 are attached to the outside surface of the drawer body by means of flanges 69.

Figure 2:
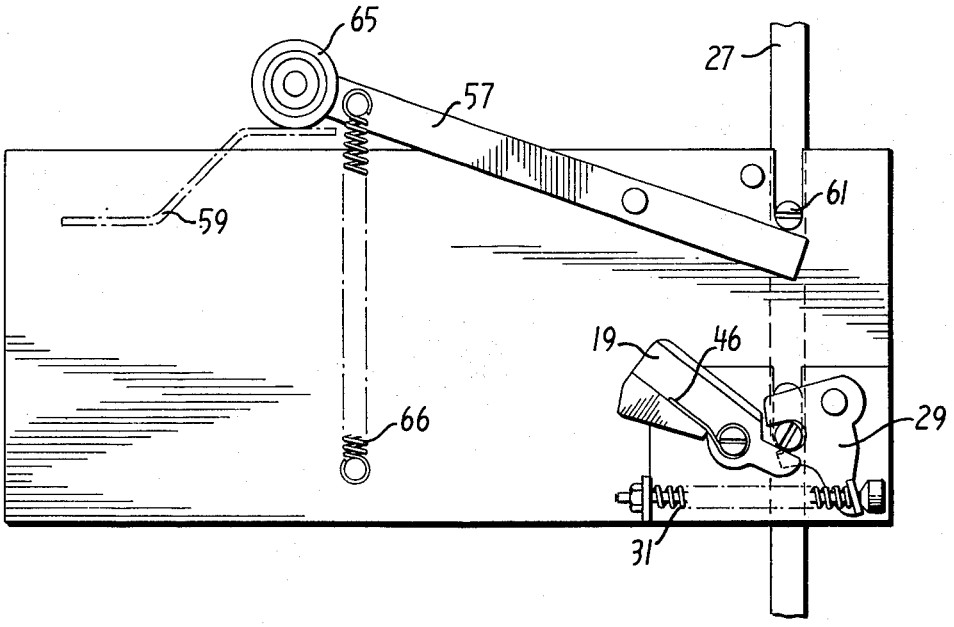
FIG. 2 is a simplified, side view of a portion of the anti-tip device of FIG. 1 when it is in a drawer unlocking position.

In operation of the anti-tip safety system, when all of the drawers 15 and 17 are in closed positions, and unlocked, the cams 59 hold the lever rollers 65 in raised positions as is depicted in FIG. 2. Thus, none of the levers 57 urge the lock rod 27 toward a raised position and the lock rod remains in a lowered, unlocking, position due to its own weight and action of the compression spring 31 via the lock lever 29. In this position, both of the latches 19 and 21—and others if more drawers are involved—are rotated in clockwise directions so that they are disengaged from the slots 45 of drawer-mounted catches 23.

Figure 3:
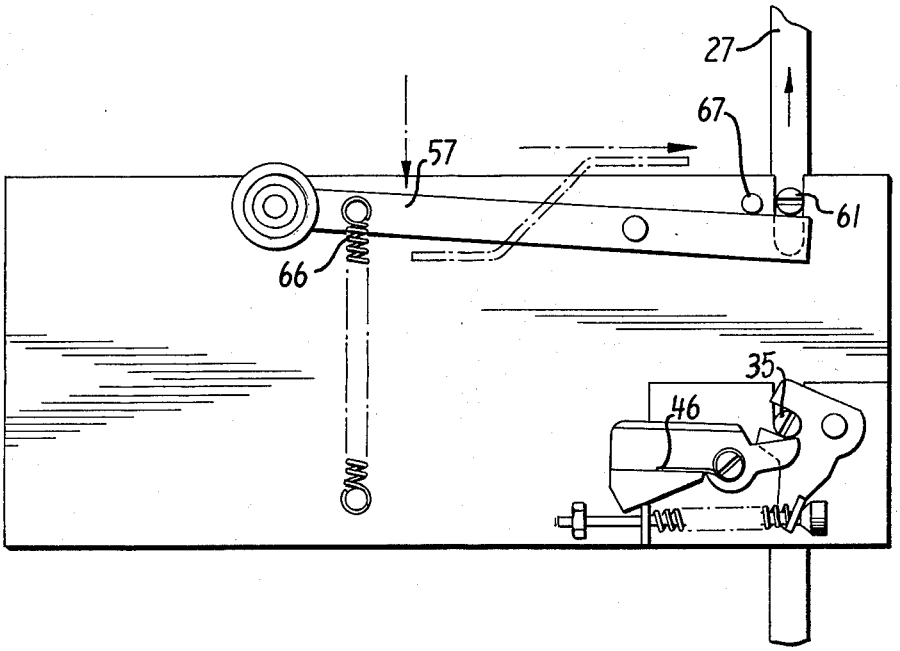
FIG. 3 is a view similar to FIG. 2 but is taken when the anti-tip device is moving to a drawer locking position.

However, when one of the drawers 15 or 17 is withdrawn from the filing cabinet 13, as is drawer 15 in FIG. 1, the lever roller 65 of that drawer rolls down the cam 59 of that drawer until it reaches the position depicted in FIG. 3. During this operation, the lock rod 27 is moved to a raised position as a result of counterclockwise rotation of the lever 57 caused by the tension spring 66. As described above, in the raised, or drawer locking, position, the lock rod latch pin 39 allows the latch of the remaining drawer—or drawers if more drawers are involved—to engage the drawer catch 23 of this drawer. Although the latch of the withdrawn drawer is also moved to an engaging position, it actually does not engage the catch of this drawer because this catch has moved with the drawer clear of the latch. When the withdrawn drawer is closed once again, its cam 59 will raise the lock rod 27 via its respective lever 57 thereby placing the lock rod 27 in a drawer unlocking position.

Figure 4:
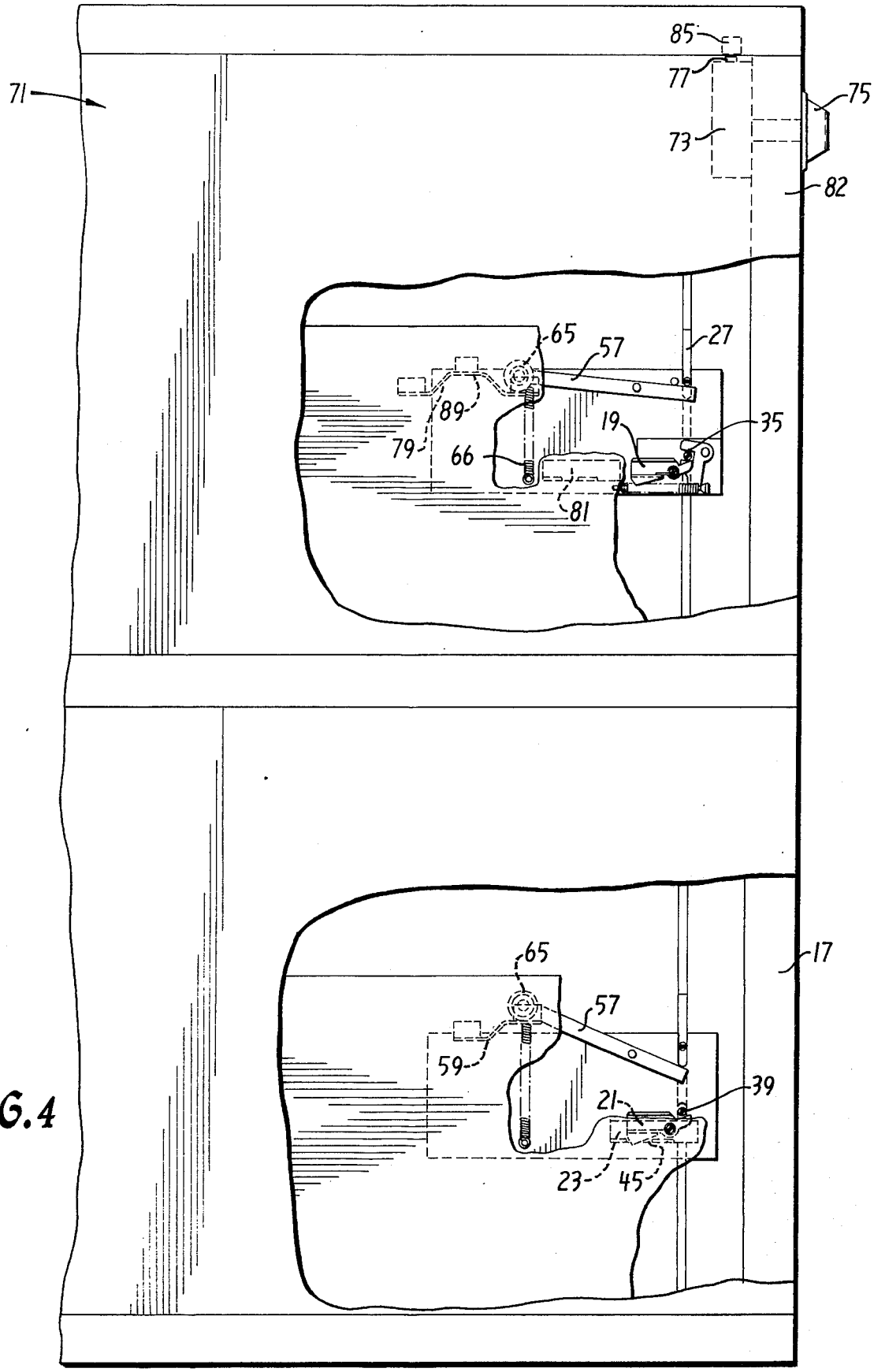
FIG. 4 is a side, cut-away view of a combination-lock filing cabinet employing a second embodiment of the anti-tip device of this invention.

FIG. 4 depicts an embodiment of this invention which is employed with filing cabinets of the type wherein all of the drawers thereof are locked by locking only a top drawer in a closed, locking position. The particular filing cabinet 71 of FIG. 4 employs a combination lock 73 having a combination dial 75 and a combination-lock latch 77. The only structural difference between the anti-tip safety system of the FIGS. 1–3 embodiment and the FIG. 4 embodiment is that a top drawer cam 79 of the FIG. 4 embodiment is shaped differently from the cams 59, and both the top drawer cam 79 and a top-drawer catch 81 of the FIG. 4 embodiment are located closer to the rear of the top drawer 82 than are the cams 59 and catches 23. For simplicity, the remaining elements of the FIG. 4 embodiment are given the same reference numerals as are similar elements in the FIGS. 1–3 embodiment.

In operation of the FIG. 4 embodiment, the drawers 82 and 17 are both locked when they are fully closed, with the combination-lock latch 77 engaging a cabinet slot 85. In this position, the lever roller 65 of the top drawer 82 is in a low position due to the tension spring 66 and its low location on the front side 87 of the cam 79. Thus, the lever 57 of the top drawer 82 lifts the lock rod 27 to a locking position where it allows the latches 19 and 21 to rotate to counterclockwise positions. In these positions, the latch 21 of the lower drawer 17 engages the slot 45 of the catch 23; however, the latch 19 does not yet engage the catch 81.

When it is desired to withdraw one of the drawers 82 or 17 from the filing cabinet 71, the combination dial 75 is manipulated to withdraw the combination-lock latch 77 from the slot 85. Before the lower drawer 17 can be withdrawn, the top drawer 78 must be pulled out—or moves out automatically depending on the arrangement—until its lever roller 65 is riding on a raised portion 89 of the cam 79. In this configuration, each of the rollers 65 are on raised portions of cams 79 and 59 so that the lock rod 27 is maintained in a lowered, drawer-unlocking position at which the latches 19 and 21 are disengaged from the catches 81 and 23, although the top-drawer catch 81 is now under the latch 19. It should be noted that the top drawer 82 is not pulled out very far in this configuration and, for all practical purposes, and for the purpose of this specification, this drawer is still in a "closed" position.

When either one of the drawers 17 or 82 is thereafter withdrawn from the filing cabinet 71, its respective roller 65 is allowed to move downwardly on one of the cams 59 or 79 to rotate the respective lever 57 in a counterclockwise direction and thereby raise the lock rod 27 to a drawer-locking position in which the latch, 19 or 21, of the other drawer engages its respective catch 25 or 81. Again, it should be understood that additional latches and catches would operate similarly if more drawers were involved.

It is clear from the above description that the drawer-cabinet anti-tip safety device of this invention is positive in action but yet is uncomplicated in structure. Further, this system can be easily integrated with various drawer-cabinet locking systems. In addition, this system does not add appreciable weight or cumbersome structure to filing cabinets.

While the invention has been particularly shown and described with reference to preferred embodiments, it will be understood by those skilled in the art that various changes in form and detail may be made therein without departing from the spirit and scope of the invention. For example, lock lever 29 and its compression spring 31 could be eliminated if they were not required for locking the filing drawers as is described above. In this regard, the compression spring 31 aids in biasing the lock rod 27 toward a lowered unlocking position; however, lock rod weight could be relied on for such biasing or a separate spring could be attached directly to the lock rod 27 to substitute for the compression spring 31.

The embodiments of the invention in which an exclusive property or privilege are claimed are defined as follows:

1. A system for interlocking cabinet drawers so that only one of a column of drawers can be withdrawn from a cabinet at a time, said system comprising:

a cabinet defining drawer cavities therein for receiving drawers;

a plurality of drawers, said drawers being slideably mounted in said drawer cavities for sliding along paths between closed positions in which they are substantially fully within said drawer cavities and withdrawn positions in which they are withdrawn from said drawer cavities;

a plurality of catches formed on said drawers for moving along paths with said drawers, there being a catch on each of said drawers;

a plurality of drawer latch means pivotally mounted on said cabinet, there being a drawer latch means mounted in each of said drawer cavities adjacent to the path of the respective catch on the drawer in said cavity, said drawer latch means pivot-ting between catch-engaging and catch-disengaging positions in which they respectively move into and out of the paths of their respective catches for engaging and disengaging their respective catches, said drawer latch means respectively individually biased toward catch-engaging positions but yet each latch means being free to pivot independently of the other latch means to said catch disengaging position to allow its respective drawer to be moved from a withdrawn position to a closed position independently of movement of the other latch means;

an actuating lock rod means slideably mounted on said cabinet close to said drawer latch means, but being separate from said drawer latch means, said lock rod means including a plurality of impinging means there being an impinging means located adjacent to each of said latch means for impinging on its respective latch means said lock rod means being longitudinally slideable between a drawer unlocking position in which its impinging means impinge on said drawer latch means to positively cause said drawer latch means to be in catch-disengaging positions and a drawer locking position in which its impinging means release said latch means to allow said latch means to rotate to catch-engaging positions and also allow said latch means freedom to pivot back to said catch-disengaging positions independently of the other latch means; and a rod moving means comprising a plurality of cams, and cam followers, there being a cam mounted on each of said drawers for moving along a path with its drawer and there being a cam follower mounted in each of said drawer cavities adjacent to the path of its respective cam, each of said cam followers being linked to said actuating lock rod means, said cams and cam followers impinging on one another to normally hold said lock rod in said drawer-unlocking position when all of said drawers are in closed positions but for moving said lock rod to said drawer-locking position in response to any one of said drawers being withdrawn from the cabinet to prevent additional drawers from being drawn from the cabinet.

2. A system for interlocking cabinet drawers as described in claim 1 wherein is further included:

a rod-biasing means connected between said cabinet and said lock-rod means for biasing said lock rod means toward said drawer-unlocking position;

an all-drawer locking mechanism mounted on one of said drawers adjacent said rod-biasing means and including a movable member which when all of said drawers are closed, is movable between an all-drawer-unlocked position, in which said movable member allows said rod biasing means to bias said lock rod means toward a drawer-unlocking position, and an all-drawer-locked position in which said movable member impinges on said biasing means to disable said biasing means and positively cause said lock rod means to be in a drawer-locking position.

3. A system for interlocking cabinet drawers as claimed in claim 2 wherein said rod biasing means comprises a rotatable locking lever linked to said lock rod means and a resilient means for urging said locking lever to rotate in a direction for moving the lock rod means toward an unlocking position.

4. A system for interlocking cabinet drawers as claimed in claim 3 wherein said all-drawer locking mechanism comprises a drawer mounted plunger which is linked to an end of said locking lever when said one drawer on which said all-drawer locking mechanism is mounted is in a closed position for rotating said locking lever when said plunger is depressed to thereby override said biasing means and move the lock rod means to a locking position.

5. A system for interlocking drawers as claimed in claim 1 wherein one of said drawers includes a manually-actuatable bolt means mounted thereon for selectively engaging said cabinet to thereby lock said one drawer in a bolt-engaged, closed, position and wherein the cam for said drawer impinges on the cam follower for said drawer for allowing said lock rod means to be in a drawer-locking position when said one drawer is placed in a totally closed, position but for moving said lock rod means to a drawer-unlocking position when said drawer is withdrawn slightly from its cavity to a bolt-disengaged, but still substantially closed, position.

* * * * *